US009406430B2

(12) United States Patent
Kuroda et al.

(10) Patent No.: US 9,406,430 B2
(45) Date of Patent: Aug. 2, 2016

(54) REACTOR

(71) Applicant: TDK CORPORATION, Tokyo (JP)

(72) Inventors: Tomofumi Kuroda, Tokyo (JP); Yu Sakurai, Tokyo (JP); Hideyuki Itoh, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/603,051

(22) Filed: Jan. 22, 2015

(65) Prior Publication Data

US 2015/0213941 A1 Jul. 30, 2015

(30) Foreign Application Priority Data

Jan. 28, 2014 (JP) ..... 2014-013330

(51) Int. Cl.

| | |
|---|---|
| ***H01F 17/06*** | (2006.01) |
| ***H01F 27/29*** | (2006.01) |
| ***H01F 27/02*** | (2006.01) |
| ***H01F 27/28*** | (2006.01) |
| ***H01F 27/24*** | (2006.01) |
| ***H01F 27/34*** | (2006.01) |
| ***H01F 3/10*** | (2006.01) |
| ***H01F 37/00*** | (2006.01) |
| *H01F 3/14* | (2006.01) |

(52) U.S. Cl.

CPC ..... *H01F 27/24* (2013.01); *H01F 3/10* (2013.01); *H01F 27/34* (2013.01); *H01F 37/00* (2013.01); *H01F 3/14* (2013.01); *H01F 2003/106* (2013.01)

(58) Field of Classification Search

CPC . H01F 41/0246; H01F 2017/048; H01F 3/14; H01F 27/24; H01F 27/34; H01F 2003/106; H01F 37/00

USPC ..... 336/178, 182, 83, 184, 192

See application file for complete search history.

(56) References Cited

U.S. PATENT DOCUMENTS

| | | | | | |
|---|---|---|---|---|---|
| 3,668,589 | A * | 6/1972 | Wilkinson | H01F 27/255 | 336/212 |
| 4,149,135 | A * | 4/1979 | Roespel | H01F 5/04 | 29/605 |
| 5,003,279 | A * | 3/1991 | Morinaga | H01F 27/292 | 336/192 |
| 5,345,209 | A * | 9/1994 | Saitoh | H01F 17/043 | 336/134 |
| 5,587,694 | A * | 12/1996 | Minato | H01F 3/14 | 336/178 |
| 6,100,783 | A * | 8/2000 | Hopkinson | H01F 27/245 | 336/216 |
| 7,057,486 | B2 * | 6/2006 | Kiko | H01F 17/043 | 336/178 |
| 8,299,885 | B2 * | 10/2012 | Ikriannikov | H01F 17/0006 | 336/212 |

(Continued)

FOREIGN PATENT DOCUMENTS

JP 2007-128951 A 5/2007

*Primary Examiner* — Elvin G Enad
*Assistant Examiner* — Kazi Hossain
(74) *Attorney, Agent, or Firm* — Oliff PLC

(57) ABSTRACT

A reactor using a composite magnetic core in which a ferrite core and a soft magnetic metal core are combined. The reactor is composed of a pair of yoke portion magnetic portions composed of a ferrite core, winding portion core(s) disposed between the opposite planes of the yoke portion cores, and coil(s) wound around the winding portion core(s). The winding portion core(s) is/are made of a soft magnetic metal core, and the cross sectional area of the part for winding the coil of the winding portion core is substantially constant. When the cross sectional area of the part for winding the coil of the winding portion core is set as S1, and the area of the parts opposite to the yoke portion cores in the winding portion core(s) is set as S2, the area ratio S2/S1 is set to be 1.3 to 4.0.

4 Claims, 4 Drawing Sheets

(56) References Cited

U.S. PATENT DOCUMENTS 8,458,890 B2 * 6/2013 Sakamoto ..... H01F 1/26
29/602.1
8,568,544 B2 * 10/2013 Engbrecht ..... B32B 13/14
156/39
2004/0085173 A1 * 5/2004 Decristofaro ..... H01F 27/245
336/178
2013/0088317 A1 * 4/2013 Tawara ..... H01F 17/06
336/212
2013/0194060 A1 * 8/2013 Nakada ..... H01F 27/00
336/192

* cited by examiner

REACTOR

The present invention relates to a reactor used in a circuit of a power supply or a power conditioner of a solar photovoltaic system or the like. Specifically, the present invention relates to an improvement for the DC (Direct Current) superposition characteristic of an inductance.

BACKGROUND

As a conventional magnetic core material for the reactor, a stacked electromagnetic steel plate or a soft magnetic metal power core can be used. Although the stacked electromagnetic steel plate has a high saturation magnetic flux density, it has a problem of that if the driving frequency in the circuit of the power supply exceeds 10 kHz, the iron loss will become greater and will cause a decreased efficiency. The soft magnetic metal powder core is widely used as the driving frequency becomes higher because its iron loss at a high frequency is less than that of the stacked electromagnetic steel plate. However, the iron loss of the soft magnetic metal powder core may not low enough, and some problems are there such as the saturation magnetic flux density is inferior to that of the electromagnetic steel plate.

On the other hand, the ferrite core is well known as a magnetic core material with a small iron loss at a high frequency. However, the ferrite core has a lower saturation magnetic flux density compared to the stacked electromagnetic steel plate or the soft magnetic metal powder core, thus a design is needed to provide a relatively large section in the magnetic core so as to avoid the magnetic saturation when a large current is applied. In this respect, a problem rises that the shape becomes larger.

In Patent Document 1, a reactor has been disclosed in which a composite magnetic core is used as the magnetic core material so that the loss, size and the weight of the core are reduced, wherein the composite magnetic core is obtained by combining a soft magnetic metal powder core used in the portion for winding the coil and a ferrite core used in the yoke portion.

PATENT DOCUMENTS

Patent Document 1: JP-A-2007-128951

SUMMARY

The loss at a high frequency will decrease when a composite magnetic core is prepared by combining the ferrite core and the soft magnetic metal core. However, when the Fe powder magnetic core or the FeSi alloy powder magnetic core both of which have a high saturation magnetic flux density is used as the soft magnetic metal core, the composite magnetic core in which the soft magnetic metal core and the ferrite core are combined will have an inferior DC superposition characteristic of the inductance compared to the core only with the soft magnetic metal core. As described in Patent Document 1, the saturation magnetic flux density of the ferrite core is lower than that of the soft magnetic metal core, so an improved effect may be obtained by increasing the cross sectional area of the ferrite core. However, the problem has not been fundamentally solved.

FIG. 4 and FIG. 5 show an example in the prior art. FIG. 4 and FIG. 5 are used to find out the reason why the DC superposition characteristic of the inductance deteriorates in the composite magnetic core in which the ferrite core and the soft metal magnetic core are combined. FIG. 4 and FIG. 5 schematically show the configuration of the junction portion for the ferrite core 21 and the soft magnetic metal core 22 as well as the flow of magnetic flux 23

The arrows in the drawings represent the magnetic flux 23. When the magnetic flux 23 in the soft magnetic metal core 22 is equivalent to that in the ferrite core 21, the number of the arrows is represented by a same number in either magnetic core. Since the magnetic flux 23 per unit area is referred to as the magnetic flux density, the narrower the space among arrows is, the higher the magnetic flux density is.

As the ferrite core 21 has a lower saturation magnetic flux density compared to the soft magnetic metal core 22, the area of the section perpendicular to the direction of the magnetic flux in the ferrite core 21 is set to be larger than that of the section perpendicular to the direction of the magnetic flux in the soft magnetic metal core 22 so as to enable a large magnetic flux to flow in the ferrite core. The end part of the soft magnetic metal core 22 is connected to the ferrite core 21, and the area of the part in which the soft magnetic metal core 22 and the ferrite core 21 face to each other is the same with the cross sectional area of the soft magnetic metal core 22.

FIG. 4 shows a case in which the current flowing in the coil is small, i.e., a case in which the magnetic flux 23 excited in the soft magnetic metal of the winding portion core is small. As the magnetic flux density of the soft magnetic metal core 22 is smaller than the saturation magnetic flux density of the ferrite core 21, the magnetic flux 23 flowing from the soft magnetic metal core 22 can directly flow into the ferrite core 21 without a leakage of the magnetic flux 23. When the current flowing in the coil is small, the decrease of the inductance is suppressed to be low.

FIG. 5 shows a case in which the current flowing in the coil is large, i.e., a case in which the magnetic flux excited in the winding portion core is large. If the magnetic flux density of the soft magnetic metal core 22 is larger compared to the saturation magnetic flux density of the ferrite core 21, the magnetic flux 23 flowing from the soft magnetic metal core 22 cannot directly flow into the ferrite core 21 through the junction portion. Instead, the magnetic flux 23 will flow through the surrounding space as shown by the dotted arrows. In other words, the magnetic flux 23 flows in the space with a relative permeability of 1, so the effective permeability decreases and the inductance also decreases sharply. That is, when a high current is superimposed by which the magnetic flux density of the soft magnetic metal core 22 is made to be larger than the saturation magnetic flux density of the ferrite 21, there is a problem that the inductance decreases. In addition, as a leakage of the magnetic flux 23 happens, the cupper loss due to the interlinking of the magnetic flux with the coil also increases.

As such, in the prior art, only the cross sectional areas of the ferrite core and the soft magnetic metal core are considered, thus the magnetic saturation in the junction portion is neglected and the DC superposition characteristic of the inductance is not sufficient.

The present invention is made to solve the problems mentioned above and aims to improve the DC superposition characteristic of the inductance in the reactor using a composite magnetic core in which the ferrite core and the soft magnetic metal core are combined.

The reactor of the present invention is composed of a pair of yoke portion cores which are made of a ferrite core, winding portion core(s) disposed between the opposite planes of the yoke portion cores, and coil(s) wound around the winding portion core. The winding portion core(s) is/are composed of a soft magnetic metal core and the cross sectional area of the part for winding the coil on the winding portion core is substantially constant. In addition, when the cross sectional area of the part for winding the coil on the winding portion core is set as S1 and the area of the opposing part for the yoke portion core facing to the winding portion core is set as S2,the area ratio S2/S1 is in a range of 1.3 to 4.0. As such, the DC superposition characteristic of the inductance can be improved in the reactor of a composite magnetic core in which the ferrite core and the soft magnetic metal core are combined to be used.

In addition, it is preferable that the winding portion core in the reactor of the present invention is formed by combining two or more soft magnetic metal cores. As such, the preparation with powder molding becomes easier, and the decrease of strength or the increase of loss due to processing for the core can be avoided.

Further, gaps are preferably disposed in the spaces where the yoke portion cores face the winding portion core(s). In this way, the magnetic permeability can be adjusted and the inductance of the reactor can be adjusted into any level easily.

According to the present invention, the DC superposition characteristic of the inductance can be improved in the reactor of the composite magnetic core in which the ferrite core and the soft magnetic metal core are combined to be used.

DETAILED DESCRIPTION OF EMBODIMENTS

Figure 6:
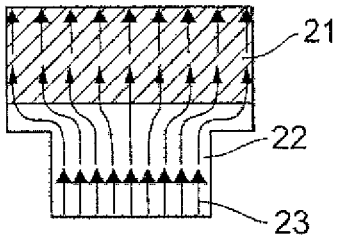
FIG. 6 is a drawing schematically showing the configuration of the junction portion for the ferrite core and the soft magnetic metal core and the flow of the magnetic flux in one embodiment of the present invention.

In the composite magnetic core in which the ferrite core and the soft magnetic metal core are combined, the inductance under DC superposition may be improved by preventing the magnetic saturation of the ferrite in the plane where the magnetic flux flows to and fro between the ferrite core and the soft magnetic metal core. FIG. 6 is used to describe the improved effect on the DC superposition characteristic of the inductance provided by the present invention.

In FIG. 6, in the winding portion core composed of the soft magnetic metal core 22, the area of the core section of the part for winding the coil which is perpendicular to the direction of the magnetic flux is set as S1, and the area of the part facing to the ferrite core 21 is set as S2. The area S2 is larger than the cross sectional area of the core S1.

When the area S2 is made to be larger than the cross sectional area of the core S1, the magnetic flux density in the part for the soft magnetic metal core 22 facing to the ferrite core 21 can be lower than that in the winding part for the coils of the soft magnetic metal core 22. Even when the current flowing in the coil is large, the magnetic flux 23 flowing from the soft magnetic metal core 22 will flow into the ferrite core 21 directly without passing through the space around and the decrease of the effective permeability can be suppressed. As a result, a high inductance can be obtained even under DC superposition.

The preferable embodiments of the present invention will be described with reference to the drawings hereinafter.

Figure 1A:
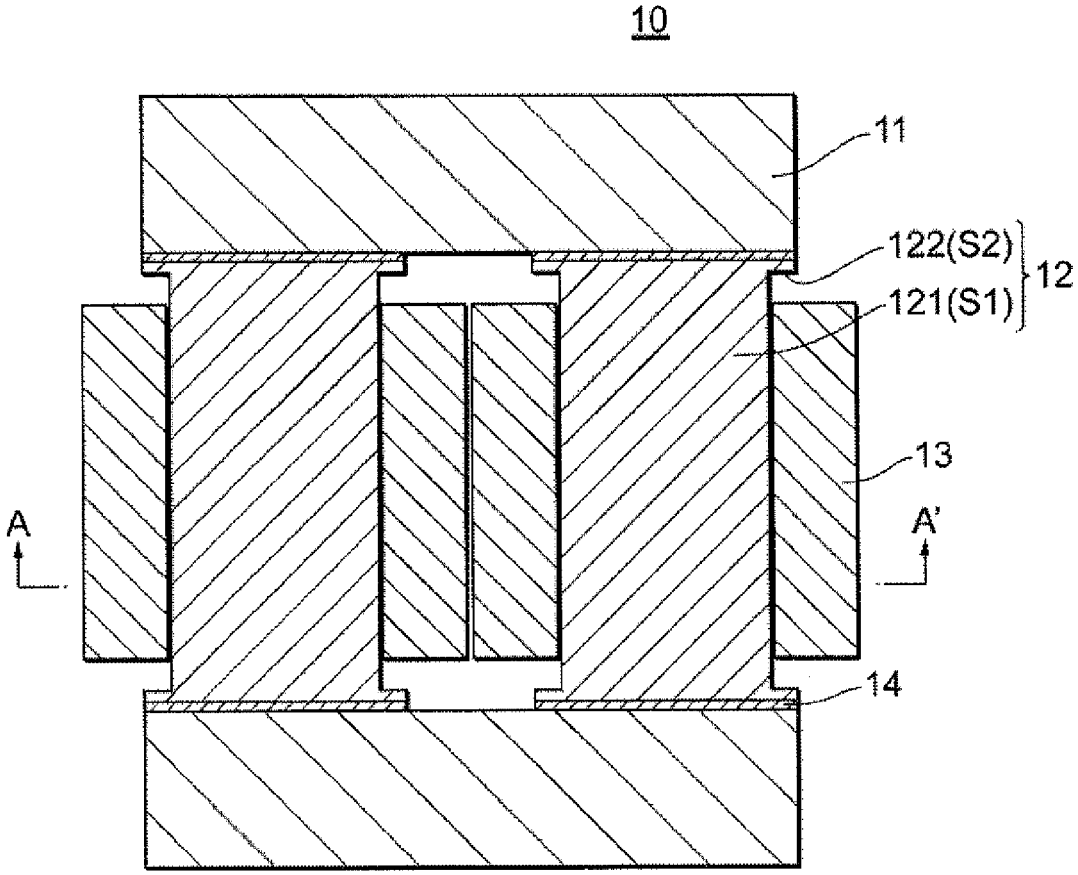
FIG. 1A is a sectional view showing the configuration of the reactor in one embodiment of the present invention.
Figure 1B:
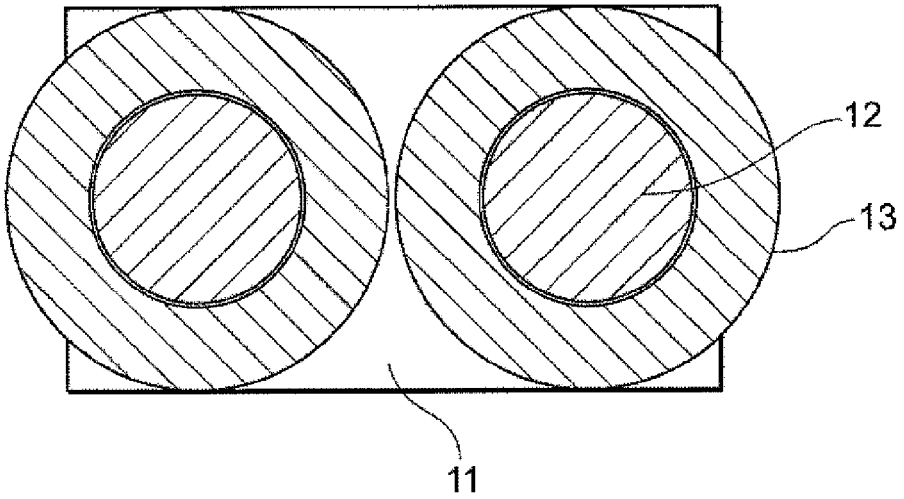
FIG. 1B is a sectional view of the reactor shown in FIG. 1A which is cut along the A-A' line.

FIGS. 1A and 1B are drawings showing the configuration of the reactor 10. FIG. 1B is a sectional view of the reactor shown in FIG. 1A which is cut along the A-A' line. The reactor 10 is provided with two yoke portion cores 11 opposite to each other, winding portion cores 12 disposed between the two yoke portion cores 11, and coils 13 winding around the winding portion cores 12. The coils 13 can be directly wound around the winding portion cores 12 or can be wound around bobbins.

The ferrite core is used in the yoke portion cores 11. The ferrite core has a substantially low loss compared to the soft magnetic metal core but has a low saturation magnetic flux density. As no coil 13 is wound around the yoke portion cores 11, the size of the coils 13 will not be affected even if the width or the thickness of the yoke portion cores is increased. Thus, the low saturation magnetic flux density can be covered by increasing the cross sectional area of the yoke portion cores 11. The cross sectional area of the yoke portion cores 11 refers to the area of the section perpendicular to the direction of the magnetic flux, and is obtained by multiplying the width by the thickness. As the ferrite core is easier to be formed than the soft magnetic metal core, it will be quite easy to prepare a core with a large cross sectional area. The MnZn based ferrite is preferably used as the ferrite core. The MnZn based ferrite is good for the miniaturization of the core because it has a less loss and a higher saturation magnetic flux density than other ferrites.

The soft magnetic metal core such as the iron powder core is used in the winding portion core 12. The winding portion core 12 contains the part 121 around which the coil 13 winds and the parts 122 opposite to the yoke portion cores 11 (herein after, the parts opposite to the yoke portion cores may be referred to as the opposing parts). The iron powder core or the FeSi alloy powder core is preferably used as the soft magnetic metal core. The iron powder core or the FeSi alloy powder core has a high saturation magnetic flux density and its iron loss at a high frequency is lower than a stacked electromagnetic steel plate, so these two cores will be favorable as the driving frequency becomes higher. The area of the section of the winding part 121 which is perpendicular to the direction of the magnetic flux is set as S1. The direction of the magnetic flux is the same with that of the magnetic field produced by the coil 13 and corresponds to the axial direction of the coil 13. The cross sectional area S1 is substantially constant in the direction of the magnetic flux. The area for the opposing part 122 facing to the yoke portion 11 is set as S2.

If the cross sectional area S1 of the coil winding part 121 becomes larger, the size of the coil 13 will become larger, so the size of the reactor 10 will be increased. Thus, the cross sectional area S1 is preferable to be small. However, if the cross sectional area S1 becomes smaller, the magnetic flux is not sufficient. In this respect, the inductance under DC superposition will decrease. In addition, if the cross sectional area S1 becomes smaller, the amplitude of the magnetic flux due to ripple becomes larger so that the loss will become larger. Therefore, the cross sectional area S1 is preferred to be as small as possible while the inductance and loss are considered at the same time.

The area S2 of the part for the core opposing part 122 facing to the yoke portion core 11 is larger than the cross sectional area S1 of the coil winding part 121. The magnetic flux density refers to the magnetic flux per unit area. As the magnetic flux flowing in the coil winding part 121 should be as same as possible with that in the core opposing part 122, the magnetic flux density in the core opposing part 122 can be smaller than that in the coil winding part 121 if the area S2 is made to be larger than the cross sectional area S1. The soft magnetic metal core with a high magnetic flux density is used in the coil winding portion core 12, so a big magnetic flux can be excited. Even if the magnetic flux density of the coil winding part 121 is higher than the saturation magnetic flux density of the ferrite core, the magnetic saturation of the ferrite core can be avoided by decreasing the magnetic flux density of the core opposing part 122.

As such, the cross sectional area S1 of the coil winding part 121 which occupied most of the winding portion core 12 can be decreased to downsize the reactor. Also, the inductance under DC superposition can be increased by avoiding the magnetic saturation of the part for the winding portion core 12 facing to the yoke portion core 11.

In addition, as no coil 13 is wound around the opposing parts 122 of the core, the inner diameter and the outer diameter of the coil 13 will not be affected even if the area of S2 is increased. The shape of the reactor 10 will not be affected even if the area of S2 is increased as long as the size of the core opposing part 122 is within a range not affecting the yoke portion core 11 or the winding portion core 12.

The area ratio S2/S1 is in a range of 1.3 to 4.0. When the area ratio S2/S1 is less than 1.3, the DC superposition characteristic of the inductance will decrease for the decreasing effect on the magnetic flux density is weakened. If the area ratio S2/S1 exceeds 4.0, the area of the core opposing part 122 will become too large. In this respect, it is necessary to enlarge the bottom area of the yoke portion core 11, leading to a decreased effect on the miniaturization. If the improvement effect on the DC superposition characteristic and the miniaturization effect are to be considered, it is more preferably that the area ratio S2/S1 is in a range of 1.5 to 3.1.

The thickness of the part with a larger area in the core opposing part 122 is 0.5 mm or more. If the thickness is less than 0.5 mm, the magnetic flux density of the magnetic flux flowing from the winding portion core 12 cannot be sufficiently decreased so that the inductance under DC superposition decreases. If the thickness is large, an improvement effect on the inductance can be sufficiently obtained. However, if the thickness is much too thick, the effect of miniaturization of the core becomes weak. In this respect, it is preferable that the thickness of the part with a larger area in the core opposing part 122 is 1.0 to 3.0 mm.

At least one set of the winding portion core 12 is disposed between the opposite yoke portion cores 11. From the viewpoint of miniaturization, the winding portion core 12 is preferably one set or two sets. According to the number of the sets of the winding portion core 12, the number of the parts where the yoke portion cores 11 face and the winding portion cores 12 face to each other will change accordingly. However, if the area ratio S2/S1 conforms the relationship mentioned above in all these parts, the best effect will be obtained in the improvement of inductance.

Preferably, the winding portion core 12 is composed of two or more soft magnetic metal cores. It is hard to prepare a core with the area at both end parts being larger than that of the central part of the winding portion core 12 by a general powder molding process. Other processes such as cutting the molded body are needed. If the molded body is subjected to a cutting process, there are risks that the strength may deteriorate as cracks are introduced and the iron loss at a high frequency is increased due to the electrical conduction on the cut plane. In order to avoid the occurrence of such problems, for example, it is easy to combine two cores which are separated from the central part in the length direction of the winding portion core 12 to only enlarge the area of one end. Also, it is easy to prepare a core with area at one end enlarged using a general powder molding process. The number of the separated parts is not limited to two, and the winding portion core 12 can be separated into three or more parts as long as the size of the winding portion core 12 or the loss is not affected.

Gaps 14 for adjusting the magnetic permeability can also be disposed in the path of the magnetic loop formed by the yoke portion cores 11 and the winding portion cores 12. No matter the gaps 14 are present or not, the effect of inductance improvement produced in the present invention can be provided. And the use of the gaps 14 can make it more freely in the design of the reactor 10, i.e., the reactor 10 can be designed to have an arbitrary inductance. The position where the gaps 14 are disposed is not particularly restricted, but the gaps 14 are preferably inserted into the spaces between the yoke portion cores 11 and the winding portion cores 12 from the viewpoint of easy operation. The gaps 14 can be made of a space or a nonmagnetic and insulating material such as ceramics, glass, an epoxy glass substrate or a resin film.

Figure 2A:
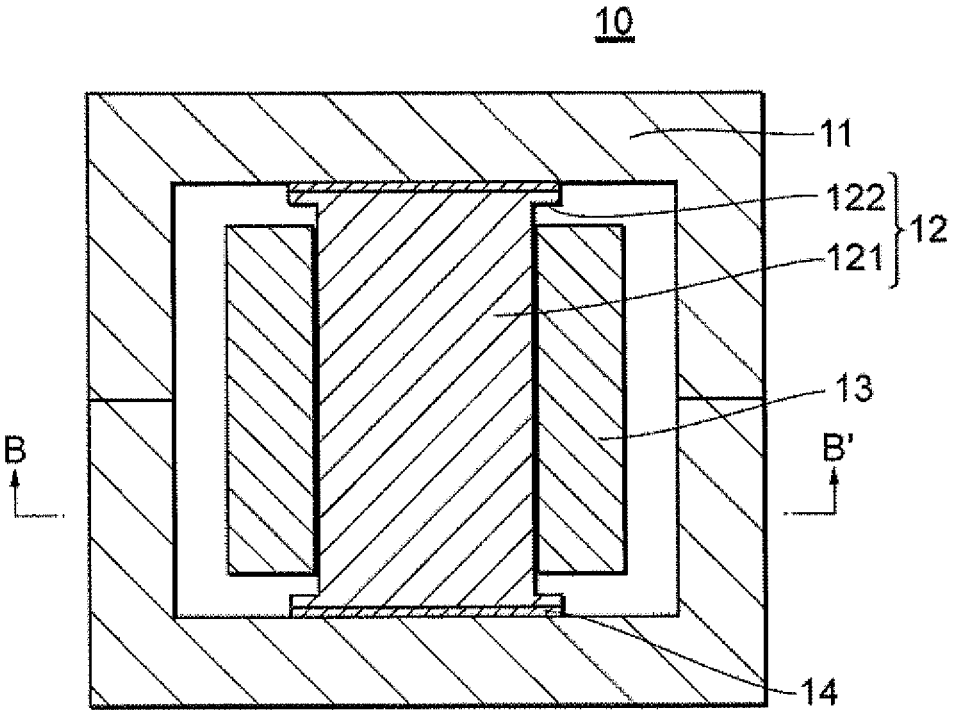
FIG. 2A is a sectional view showing the configuration of the reactor in another embodiment of the present invention.
Figure 2B:
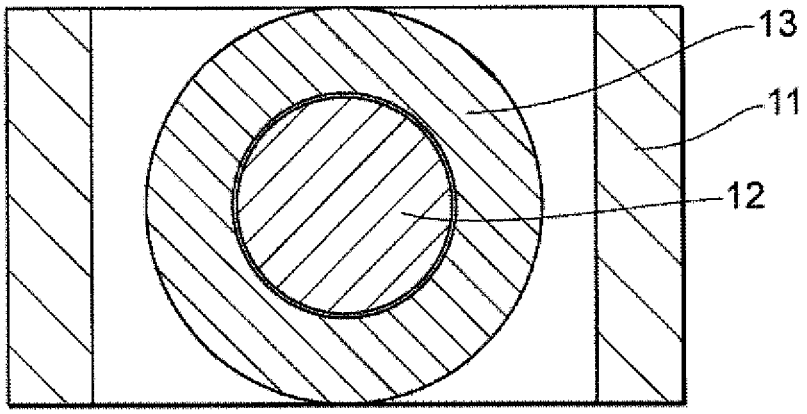
FIG. 2B is a sectional view of the reactor shown in FIG. 2A which is cut along the B-B' line.

FIG. 2 is a sectional view showing the configuration of the reactor in another embodiment of the present invention. FIG. 2B is a sectional view of the reactor in FIG. 2A cut along the B-B' line. The yoke portion core 11 is a ferrite core shaped like "コ" and is provided with a back part and foot parts at both ends. The winding portion core 12 is a soft magnetic metal core. The yoke portion cores 11 are opposite to each other to form a "口" shaped magnetic loop as shown in FIG. 2. One set of the winding portion core 12 is disposed at the central part of the yoke portion cores 11, and the coil 13 with a defined number of turns is wound around the portion for winding in the winding portion core 12 to constitute the reactor 10. The coil 13 can be directly wound around the winding portion core 12 or can be wound around a bobbin. The area S2 of the part for the core opposing part 122 facing to the yoke portion core 11 is larger than the cross sectional area S1 of the coil winding part 121. The area ratio S2/S1 is preferably in a range of 1.3 to 4.0. The embodiment shown in FIG. 2 is substantially the same as that shown in FIG. 1 except for the shape of the yoke portion core 11.

The preferable embodiments of the present invention have been described above. However, the present invention is not limited to these embodiments. The present invention can be variously modified without departing from the spirit and scope.

EXAMPLES

Example 1

With respect to the embodiment shown in FIG. 1, the properties were compared when the cross sectional area S1 of the winding part 121 in the winding portion core 12 was set to be constant and the area S2 of the core opposing part 122 was changed.

Examples 1-1 to 1-4 and Comparative Example 1-1

A cuboid MnZn ferrite core (PE22, produced by TDK Corporation) was used in the yoke portion core with a length of 80 mm, a width of 45 mm and a thickness of 20 mm.

An iron powder core was used in the winding portion core. The iron powder core was prepared to have a height of 25 mm, and the diameter of the winding part was 24 mm. The diameter on one end was increased to make the area S2 of the core opposing part be the one listed in Table 1. The thickness of the part on the end where the diameter was increased was made to be 2 mm. The Somaloy 110i produced by Höganäs AB Corporation was used as the iron powder. The iron powder was filled into a mold coated with zinc stearate as the lubricant and was then subjected to a pressing forming under a pressure of 780 MPa to provide a molded body with a specified shape. The molded body was annealed at 500° C. to provide the iron powder core. Two obtained coil winding portions of iron powder magnetic core were bonded to constitute one set of the winding portion core.

Two sets of winding portion cores were disposed between two opposite yoke portion cores, and a coil with a number of turns of 44 was wound around the winding part of the winding portion core to provide a reactor (Examples 1-1 to 1-4 and Comparative Example 1-1).

Figure 3A:
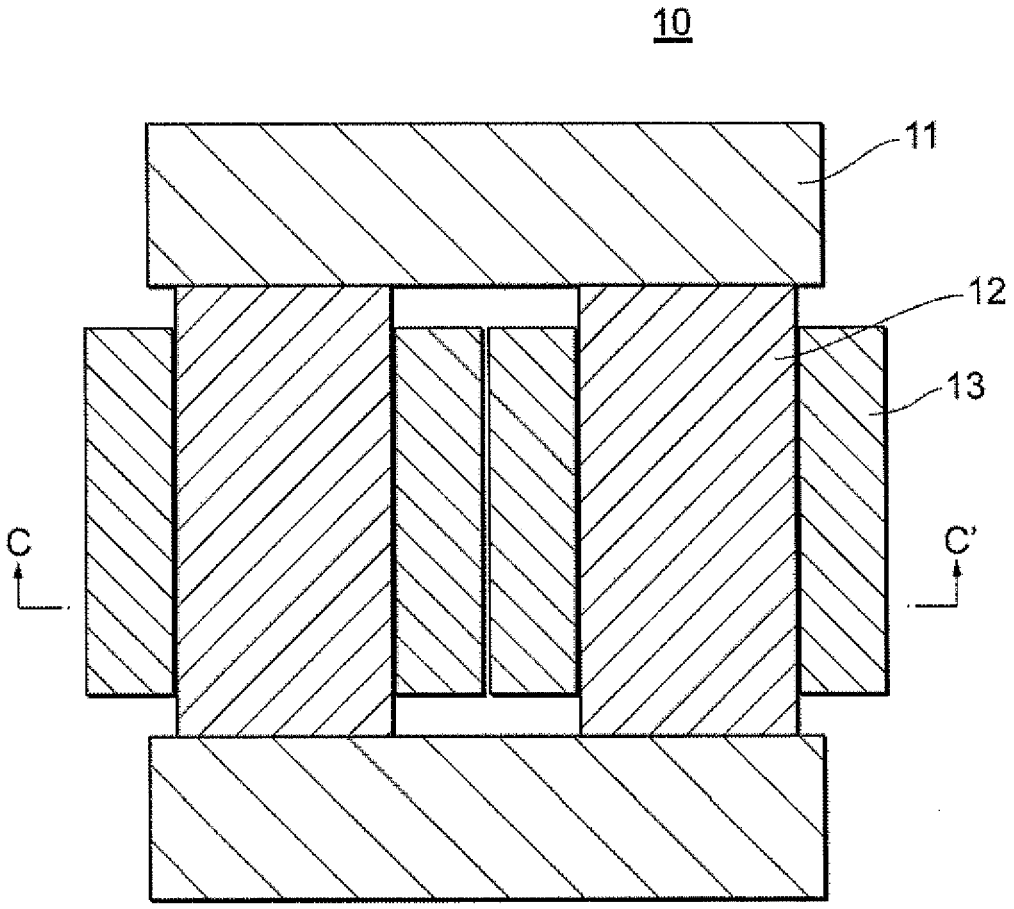
Prior Art Figure3A
FIG. 3A is a sectional view showing the configuration of the reactor in the prior art.
Figure 3B:
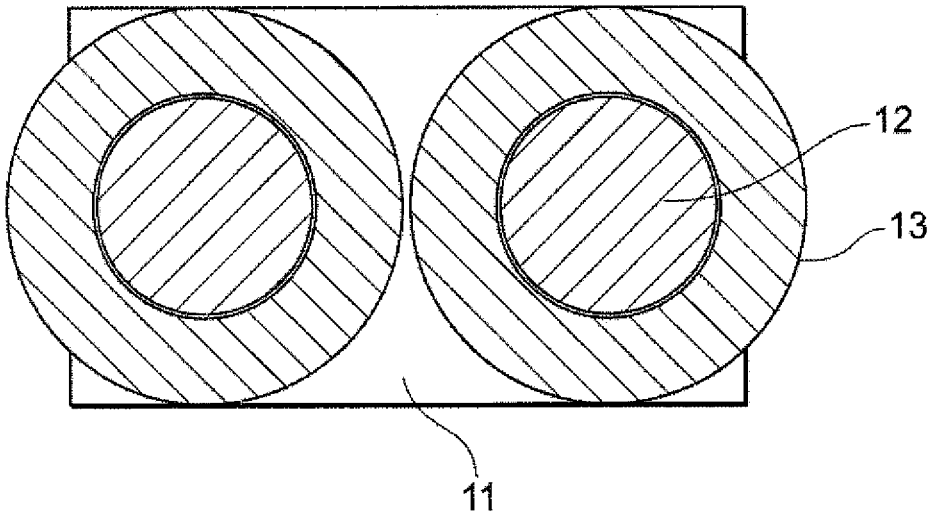
Prior Art Figure3B
FIG. 3B is a sectional view of the reactor shown in FIG. 3A which is cut along the C-C' line.
Figure 4:
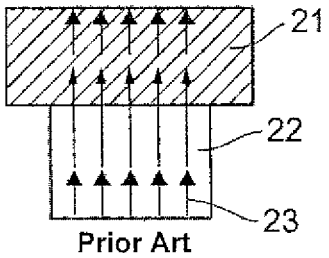
FIG. 4 is a drawing schematically showing the configuration of the junction portion for the ferrite core and the soft magnetic metal core and the flow of the magnetic flux in the prior art.
Figure 5:
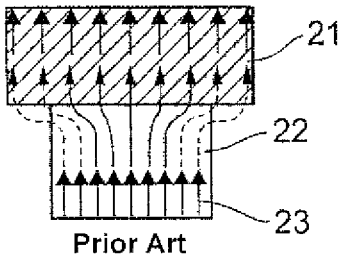
FIG. 5 is a drawing schematically showing the configuration of the junction portion for the ferrite core and the soft magnetic metal core and the flow of the magnetic flux in the prior art.

In addition, with respect to the embodiment shown in FIG. 3, the property was evaluated in the conventional configuration in which the cross sectional area of the junction portion for the winding portion core and the yoke portion core was not considered. Further, FIG. 3B was a sectional view showing the reactor of FIG. 3A cut along the C-C' line.

Comparative Example 1-2

A cuboid MnZn ferrite core (PE22, produced by TDK Corporation) was used in the yoke portion core with a length of 80 mm, a width of 45 mm and a thickness of 20 mm.

An iron powder core was used in the winding portion core. The iron powder core was prepared to have a height of 25 mm and a diameter of 24 mm. The Somaloy 110i produced by Höganäs AB Corporation was used as the iron powder. The iron powder was filled into a mold coated with zinc stearate as the lubricant and was then subjected to a pressing forming under a pressure of 780 MPa to provide a molded body. The molded body was annealed at 500° C. to provide the iron powder core. Two obtained iron powder cores were bonded to constitute one set of the winding portion core.

Two sets of winding portion cores were disposed between two opposite yoke portion cores, and a coil with a number of turns of 44 was wound around the winding part of the winding portion core to provide a reactor (Comparative Example 1-2).

The inductance and the iron loss at a high frequency were evaluated in the obtained reactors (Examples 1-1 to 1-4 and Comparative Examples 1-1 to 1-2).

The DC superposition characteristic of the inductance was measured by using a LCR meter (4284A, produced by Agilent Technologies Corporation) and a DC bias supply (42841A, produced by Agilent Technologies Corporation). As there was variability in the magnetic permeability of the prepared winding portion core, materials for gap were inserted into four spaces between the yoke portion cores and the winding portion cores as according to the needs to make the initial inductance be 600 μH when no DC current was applied. A PET (polyethylene terephthalate) film which was a nonmagnetic and insulating material was used as the material for gap. Regarding the DC superposition characteristic, the inductance was measured when the rated current was 20 A. The thickness of the material for gap and the DC superposition characteristic were shown in Table 1.

The iron loss at a high frequency was measured by using a BH analyzer (SY-8258, produced by Iwatsu Test Instruments Corporation). The f was set to be 20 kHz and Bm was set to be 50 mT in the measurement of the loss of the core. The excitation coil had a number of turns of 25 and the search coil had a number of turns of 5. These two coils were wound around one winding portion core to perform the measurement. The result in the measurement of iron loss was shown in Table 1.

TABLE 1

| | No. | Cross sectional area of the winding part S1 [mm$^2$] | Cross sectional area of the opposing part S2 [mm$^2$] | Area ratio S2/S1 | Gap [mm] | inductance L at 0 A [μH] | inductance L at 20 A [μH] | Reduction rate of L ΔL/L0 | Iron loss at a high frequency Pc 20 kHz, 50 mT [W] |
|---|---|---|---|---|---|---|---|---|---|
| Comparative Example | 1-1 | 452 | 491 | 1.09 | 0.00 | 600 | 410 | −32% | 2.1 |
| Example | 1-1 | 452 | 661 | 1.46 | 0.30 | 600 | 540 | −10% | 2.1 |
| Example | 1-2 | 452 | 707 | 1.56 | 0.00 | 600 | 520 | −13% | 2.3 |
| Example | 1-3 | 452 | 908 | 2.01 | 0.00 | 600 | 540 | −10% | 2.4 |
| Example | 1-4 | 452 | 1385 | 3.07 | 0.30 | 600 | 530 | −12% | 2.2 |
| Comparative Example | 1-2 | 452 | 452 | 1.00 | 0.00 | 600 | 370 | −38% | 2.5 |

As can be known from Table 1, in Comparative Example 1-2 with a conventional configuration, the inductance at a current with DC superposition of 20 A was decreased by almost 40% compared to the initial inductance (600 μH) to obtain only a low inductance of 370 μH. In Comparative Example 1-1, by setting the area S2 to be larger than the cross sectional area S1, the value of the inductance under DC superposition (the current with DC superposition was 20 A) was improved to a level of 410 μH. However, as the area ratio S2/S1 was lower than 1.3, the inductance was decreased by more than 30% compared to the initial inductance (600 μH). In the reactors of Examples 1-1 to 1-4, as the area ratio S2/S1 was within the range of 1.3 to 4.0, the inductance at a current with DC superposition of 20 A was sufficiently improved to a level of 500 μH or more, of which the decrease relative to the initial inductance was suppressed to be 30% or less. In addition, it was confirmed that the iron loss at a high frequency was almost the same.

In Examples 1-1 and 1-4, gaps (0.30 mm) were inserted between the yoke portion cores and the winding portion cores and no gap was inserted in Examples 1-2 and 1-3. In all these cases, the inductance was 500 μH or more, of which the decrease relative to the initial inductance (600 μH) was suppressed to be 30% or less. Thus, by setting gaps at the spaces between the yoke portion cores and the winding portion cores, the improvement effect on the inductance would not deteriorate and the initial inductance could be easily adjusted.

Further, when the area ratio S2/S1 exceeded 4.0, the area of the end part in the winding portion core S2 was larger than 1810 $mm^2$. Two sets of winding portion cores provided an area larger than 3620 $mm^2$, and such an area was larger than the bottom area of the yoke portion core (3600 $mm^2$=80 mm in length×45 mm in width). In this respect, the reactor could not be assembled if the size of the yoke portion core was not increased. The miniaturization requirement could not be met.

Example 2

With respect to the embodiment shown in FIG. 1, the properties were compared when the cross sectional area S1 of the winding part 121 in the winding portion core 12 was set to be constant and the area S2 of the core opposing part 122 was changed.

Examples 2-1 to 2-4 and Comparative Example 2-1

A cuboid MnZn ferrite core (PE22, produced by TDK Corporation) was used in the yoke portion core with a length of 88 mm, a width of 48 mm and a thickness of 20 mm.

A FeSi alloy powder core was used in the winding portion core. Three FeSi alloy powder cores were prepared with a height of 24 mm, and the diameter of the winding part was 26 mm. In two out of the three cores, the diameter on one end was increased to make the area S2 of the opposing part be the value listed in Table 2. The thickness of the part on the end where the diameter was increased was made to be 2 mm. The composition of the FeSi alloy powder was Fe-4.5% Si. The alloy powder was prepared by water atomization, and the particle size was adjusted by a screening process to have an average diameter of 50 μm. A silicone resin was added into the obtained FeSi alloy powder in an amount of 2 mass %, and the mixture was mixed for 30 minutes at room temperature by using a pressurized kneader. Then, the resin was coated on the surface of the soft magnetic powder. The resultant mixture was subjected to a finishing process by using a mesh with an aperture of 355 μm to prepare particles. The obtained particles were filled into a mold coated with zinc stearate as the lubricant, and a pressing forming was performed under a pressure of 980 MPa to provide a molded body with a diameter of 26 mm and a height of 24 mm. The molded body was annealed at 700° C. under an atmosphere of nitrogen. The three obtained winding parts made of FeSi alloy powder cores were bonded to provide a set of winding portion core.

Two sets of winding portion cores were disposed between two opposite yoke portion cores, and a coil with a number of turns of 50 was wound around the winding part of the winding portion core to provide a reactor (Examples 2-1 to 2-4 and Comparative Example 2-1).

In addition, with respect to the embodiment shown in FIG. 3, the property was evaluated in the conventional configuration in which the cross sectional area of the junction portion for the winding portion core and the yoke portion core was not considered.

Comparative Example 2-2

A cuboid MnZn ferrite core (PE22, produced by TDK Corporation) was used in the yoke portion core with a length of 88 mm, a width of 48 mm and a thickness of 20 mm.

A FeSi alloy powder core was used in the winding portion core. The FeSi alloy powder core was prepared with a diameter of 26 mm and a height of 24 mm. Three FeSi alloy powder cores obtained as in Examples 2-1 to 2-4 were bonded to provide one set of winding portion core.

Two sets of winding portion cores were disposed between two opposite yoke portion cores, and a coil with a number of turns of 50 was wound around the winding part of the winding portion core to provide a reactor (Comparative Example 2-2).

The inductance and the iron loss at a high frequency were evaluated in the obtained reactors (Examples 2-1 to 2-4 and Comparative Examples 2-1 to 2-2).

The DC superposition characteristic of the inductance was measured in the same way as that in Example 1. In order to adjust the variation of the inductance due to the magnetic permeability of the prepared winding portion core, materials for gap were inserted into the four spaces between the yoke portion cores and the binding portion cores to make the initial inductance be 700 μH when no DC current was applied. Regarding the DC superposition characteristic, the inductance was measured when the rated current was 26 A. The thickness of the material for gap and the DC superposition characteristic were shown in Table 2.

The iron loss at a high frequency was measured in the same way as in Example 1. The f was set to be 20 kHz and Bm was set to be 50 mT in the measurement of the loss of the core. The excitation coil had a number of turns of 25 and the search coil had a number of turns of 5. These two coils were wound around one winding portion core to perform the measurement. The result in the measurement of iron loss was shown in Table 2.

TABLE 2

| | No. | Cross sectional area of the winding part S1 [$mm^2$] | Cross sectional area of the opposing part S2 [$mm^2$] | Area ratio S2/S1 | Gap [mm] | inductance L at 0 A [μH] | inductance L at 26 A [μH] | Reduction rate of L ΔL/L0 | Iron loss at a high frequency Pc 20 kHz, 50 mT [W] |
|---|---|---|---|---|---|---|---|---|---|
| Comparative Example | 2-1 | 530 | 573 | 1.08 | 0.30 | 700 | 430 | −39% | 1.6 |
| Example | 2-1 | 530 | 707 | 1.33 | 0.50 | 700 | 530 | −24% | 1.4 |
| Example | 2-2 | 530 | 804 | 1.52 | 0.30 | 700 | 530 | −24% | 1.5 |
| Example | 2-3 | 530 | 1018 | 1.92 | 0.50 | 700 | 550 | −21% | 1.5 |
| Example | 2-4 | 530 | 1590 | 3.00 | 0.50 | 700 | 570 | −19% | 1.5 |
| Comparative Example | 2-2 | 530 | 531 | 1.00 | 0.30 | 700 | 400 | −43% | 1.4 |

As can be known from Table 2, in Comparative Example 2-2 with a conventional configuration, the inductance at a current with DC superposition of 26 A was decreased by a level more than 40% compared to the initial inductance (700 μH) to obtain only a low inductance of 400 μH. In Comparative Example 2-1, by setting the area S2 to be larger than the cross sectional area S1, the value of the inductance under DC superposition was improved to a level of 430 μH. However, as the area ratio S2/S1 was lower than 1.3, the inductance was decreased by a level more than 30% compared to the initial inductance (700 μH). In the reactors of Examples 2-1 to 2-4, the inductances at a current with DC superposition of 26 A were 525 μH or more, of which the decrease from the initial inductance (700 μH) was suppressed to be 30% or less. In addition, it was confirmed that the iron loss at a high frequency was almost the same. The improvement effect on the DC superposition characteristic of the inductance could be provided even if the size of the core or the number of turns of the coil was changed.

Further, when the area ratio S2/S1 exceeded 4.0, the area of the end part in the winding portion core S2 was larger than 2120 $mm^2$. Two sets of the winding portion cores provided an area larger than 4240 $mm^2$, and such an area was larger than the bottom area of the yoke portion core (4224 $mm^2$=88 mm in length×48 mm in width). In this respect, the reactor could not be assembled if the size of the yoke portion core was not enlarged. The miniaturization requirement could not be met.

Example 3

With respect to the embodiment shown in FIG. 2, the properties were compared when the cross sectional area S1 of the winding part 121 in the winding portion core 12 was set to be constant and the area S2 of the core opposing part 122 was changed.

Example 3-1

The yoke portion cores 11 were a MnZn ferrite core shaped like "コ" (PC90, produced by TDK Corporation), wherein the back part had a length of 80 mm, a width of 60 mm and a thickness of 10 mm, and the foot parts had a length of 14 mm, a width of 60 mm and a thickness of 10 mm.

A FeSi alloy powder core was used in the winding portion core. The FeSi alloy powder had a composition of Fe-4.5% Si. The alloy powder was prepared by water atomization, and the particle size was adjusted by a screening process to have an average diameter of 50 rim. A silicone resin was added into the obtained FeSi alloy powder in an amount of 2 mass %, and the mixture was mixed for 30 minutes at room temperature by using a pressurized kneader. Then, the resin was coated on the surface of the soft magnetic powder. The resultant mixture was subjected to a finishing process by using a mesh with an aperture of 355 μm to prepare particles. The obtained particles were filled into a mold coated with zinc stearate as the lubricant, and a pressing forming was performed under a pressure of 980 MPa to provide a molded body with a diameter of 30 mm and a height of 28 mm. The obtained molded body was performed with a process to cut the part which was deemed as the coil winding part to make the diameter of the winding part be 24 mm with the diameter of the two end parts still being 30 mm. Then, the molded body was annealed at 700° C. under an atmosphere of nitrogen. The resultant FeSi alloy powder core was used as the winding portion core.

As shown in FIG. 2, the yoke portion cores face to each other to form a magnetic loop shaped like "口", and into the central part one set of winding portion core was disposed. A coil with a number of turns of 38 was wound around the winding part of the winding portion core to prepare a reactor (Example 3-1).

Comparative Example 3-1

The yoke portion cores 11 were a MnZn ferrite core shaped like "コ" (PC90, produced by TDK Corporation), wherein the back part had a length of 60 mm, a width of 60 mm and a thickness of 10 mm, and the foot parts had a length of 14 mm, a width of 60 mm and a thickness of 10 mm.

A FeSi alloy powder core was used in the winding portion core. The FeSi alloy powder core was made to have a height of 24 mm, and the diameter of the winding part was 24 mm. The FeSi alloy powder core obtained in the same way as in Example 3-1 except for the shape of the core was used as the winding portion core.

As shown in FIG. 2, the yoke portion cores face to each other to form a magnetic loop shaped like "口", and into the central part one set of winding portion core was disposed. A coil with a number of turns of 38 was wound around the winding part of the winding portion core to prepare a reactor (Comparative Example 3-1).

The inductance and the iron loss at a high frequency were evaluated in the obtained reactors (Example 3-1 and Comparative Example 3-1).

The DC superposition characteristic of the inductance was measured as in Example 1. Materials for gap with a thickness of 0.5 mm were inserted into two spaces between the yoke portion cores and the binding portion magnetic core to make the initial inductance be 570 μH when no DC current was applied. Before the materials for gap were inserted, the height of the foot part was adjusted by grinding so as to eliminate the space between the opposite foot parts of the ferrite cores. Regarding the DC superposition characteristics, the inductance was measured when the rated current was 20 A, and the result was shown in Table 3.

The iron loss at a high frequency was measured in the same way as in Example 1. The f was set to be 20 kHz and Bm was set to be 50 mT in the measurement of the loss in the magnetic core. The excitation coil had a number of turns of 25 and the search coil had a number of turns of 5. These two coils were wound around the winding portion core to perform the measurement. The result in the measurement of iron loss was shown in Table 3.

TABLE 3

| | No. | Cross sectional area of winding part S1 [$mm^2$] | Cross sectional area of the opposing part S2 [$mm^2$] | Area ratio S2/S1 | Gap [mm] | inductance L at 0 A [μH] | inductance L at 20 A [μH] | Reduction rate of L ΔL/L0 | Iron loss at a high frequency Pc 20 kHz, 50 mT [W] |
|---|---|---|---|---|---|---|---|---|---|
| Example | 3-1 | 452 | 707 | 1.56 | 0.50 | 570 | 480 | −16% | 0.81 |
| Comparative Example | 3-1 | 452 | 452 | 1.00 | 0.50 | 570 | 280 | −51% | 0.93 |

As can be known from Table 3, in the reactor of Comparative Example 3-1, the inductance at a current with DC superposition of 20 A was decreased by a level more than 50% from the initial inductance (570 μH) to obtain only a low inductance of 280 μH. On the other hand, in the reactor of Example 3-1, the inductance at a current with DC superposition of 20

A was 500 μH, of which the decrease from the initial inductance (570 μH) was suppressed to be 30% or less. Further, the iron loss at a high frequency was confirmed to almost the same.

If the Example 2-1 was compared with Example 3-1, it could be determined that the iron loss at a high frequency was decreased. When one set of winding portion core was disposed as shown in the embodiment of FIG. 2, the percentage occupied by the ferrite core was increased in the magnetic loop of the composite magnetic core so the loss could be effectively reduced by taking advantage of the low loss of the ferrite.

In Examples 1-1 to 1-4, one set of winding portion core was composed of two soft magnetic metal cores. In Examples 2-1 to 2-4, one set of winding portion core was composed of three soft magnetic metal cores. In Example 3-1, one set of winding portion core was composed of one soft magnetic metal core. In all of the cases, the improvement effect on the DC superposition characteristic of the inductance was observed. However, as the magnetic core needed to be cut in Example 3-1, it might be easier to bond two or more soft magnetic metal cores as in Examples 1-1 to 1-4 or in Examples 2-1 to 2-4.

As described above, the reactor of the present invention has the loss decreased and also has a high inductance even under DC superposition so that a high efficiency and miniaturization can be realized. Therefore, such a reactor can be widely and effectively used in an electric or magnetic device such as a circuit of a power supply or a power conditioner.

DESCRIPTION OF REFERENCE NUMERALS

10. reactor
11. yoke portion core
12. winding portion core
121. winding part
122. part opposite to yoke portion core (opposing part)
13. coil
14. gap
21. ferrite core
22. soft magnetic metal core
23. magnetic flux

What is claimed is:

1. A reactor composed of a pair of yoke portion cores composed of ferrite, a winding portion core disposed spanning the yoke portion cores, and a coil wound around the winding portion core, the winding portion core is made of a soft magnetic metal, a cross sectional area of a part of the winding portion core where the coil is wound is substantially constant, when the cross sectional area of the part of the winding portion core where the coil is wound is set as S1 and an area of each part of the winding portion core adjacent to each of the yoke portion cores is set as S2, an area ratio of S2/S1 is within a range of 1.3 to 4.0.

2. The reactor of claim 1, wherein, the winding portion core is formed by combining two or more soft magnetic metal cores.

3. The reactor of claim 1, wherein, a gap is provided at a space where each of the yoke portion cores faces the winding portion core.

4. The reactor of claim 1, comprising a plurality of winding portion cores with a respective plurality of coils.

* * * * *